US007843405B2

(12) United States Patent
Choi et al.

(10) Patent No.: US 7,843,405 B2
(45) Date of Patent: Nov. 30, 2010

(54) PLASMA DISPLAY APPARATUS AND METHOD OF DRIVING THE SAME

(75) Inventors: Il Hoon Choi, Gyeongsangbuk-do (KR); Sang Jin Yoon, Gyeongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 1522 days.

(21) Appl. No.: 11/111,737

(22) Filed: Apr. 22, 2005

(65) Prior Publication Data

US 2005/0248507 A1 Nov. 10, 2005

(30) Foreign Application Priority Data

Apr. 23, 2004 (KR) ..... 10-2004-0028225

(51) Int. Cl.
*G09G 3/28* (2006.01)

(52) U.S. Cl. ..... 345/63; 345/67; 345/68

(58) Field of Classification Search ..... 345/63, 345/60, 67, 68
See application file for complete search history.

(56) References Cited

U.S. PATENT DOCUMENTS 7,221,335 B2 * 5/2007 Jeong ..... 345/63
2005/0073616 A1 4/2005 Joo et al.

FOREIGN PATENT DOCUMENTS

CN 1637800 A 7/2005
EP 0 982 707 A1 3/2000
EP 1 315 139 A2 5/2003
JP 2004-252455 9/2004
JP 2005-107544 4/2005

* cited by examiner

*Primary Examiner*—Amr Awad
*Assistant Examiner*—Yong Sim
(74) *Attorney, Agent, or Firm*—McKenna Long & Aldridge LLP

(57) ABSTRACT

A plasma display apparatus and method of driving the same is disclosed. The plasma display apparatus includes a calculation unit for calculating an average picture level of an input picture, a sub-field mapping unit for mapping data of the input picture to a first sub-field group and a second sub-field group, and a controller for controlling a time range between the data mapped to the first sub-field group and the data mapped to the second sub-field group according to the average picture level. If the average picture level is calculated at a first level, a generating time point of the data mapped to the second sub-field group is controlled to be at a first starting time point. If the average picture level is calculated at a second level higher than the first level, the generating time point of the data mapped to the second sub-field group is controlled to be at a second starting time point later than the first starting time point. If the average picture level is calculated at a third level higher than the second level, the generating time point of the data mapped to the second sub-filed group is controlled to be at a third starting time point earlier than the second starting time point.

9 Claims, 8 Drawing Sheets

PLASMA DISPLAY APPARATUS AND METHOD OF DRIVING THE SAME

CROSS-REFERENCES TO RELATED APPLICATIONS

This Nonprovisional application claims priority under 35 U.S.C. §119(a) on Patent Application No. 10-2004-0028225 filed in Korea on Apr. 23, 2004 the entire contents of which are hereby incorporated by reference.

BACKGROUND OF THE INVENTION

1. Field of the Invention

The present invention relates to a plasma display apparatus and method of driving the same, and more particularly, to a plasma display apparatus and method of driving the same, wherein contour noise and flicker are reduced considering the brightness of an image.

2. Background of the Related Art

Generally, a plasma display panel (hereinafter, referred to as a "PDP") is adapted to display an image by light-emitting phosphors with ultraviolet generated during the discharge of an inert mixed gas such as He+Xe or Ne+Xe. This PDP can be easily made thin and large, and it can provide greatly enhanced image quality with the recent development of the relevant technology. Particularly, a three-electrode AC surface discharge type PDP has advantages of lower driving voltage and longer life span as a wall charge is accumulated on a surface in discharging and electrodes are protected from sputtering caused by discharging.

FIG. 1 is a perspective view illustrating the construction of a discharge cell of a conventional three-electrode AC surface discharge type PDP.

Referring now to FIG. 1, the three-electrode AC surface discharge type PDP includes a number of scan electrodes Y and a number of sustain electrodes Z, which are formed on a bottom surface of an upper substrate 10, and an address electrode X formed on a lower substrate 18.

The discharge cell of the PDP is formed every intersection of the scan electrodes Y, the sustain electrodes Z and the address electrodes X, and is arranged in the matrix form.

Each of the scan electrodes Y and the sustain electrodes Z includes a transparent electrode 12, and a metal bus electrode 11 which has a line width narrower than that of the transparent electrode 12 and is disposed at one side of the transparent electrode 12. The transparent electrode 12, which is generally made of ITO (Indium Tin Oxide), is formed on the bottom surface of the upper substrate 10. The metal bus electrode 11, which is generally made of metal, is formed on the transparent electrode 12, and serves to reduce a voltage drop caused by the transparent electrode 12 having high resistance. On the bottom surface of the upper substrate 10 in which the scan electrodes Y and the sustain electrodes Z are disposed is laminated an upper dielectric layer 13 and a protective layer 14. The upper dielectric layer 13 is accumulated with a wall charge generated during plasma discharging. The protective layer 14 serves to protect the electrodes Y and Z and the upper dielectric layer 13 from sputtering caused upon plasma discharging, and also to improve efficiency of secondary electron emission. Magnesium oxide (MgO) is generally used as the protective layer 14.

The address electrodes X are formed on the lower substrate 18 in a direction in which they cross the scan electrodes Y1 to Yn and the sustain electrodes Z. On the lower substrate 18 is formed a lower dielectric layer 17 and barrier ribs 15. A phosphor layer 16 is coated on the surfaces of both the lower dielectric layer 17 and the barrier ribs 15. The barrier ribs 15 physically divide the discharge cells. The phosphor layer 16 is excited with an ultraviolet generated during the plasma discharging to generate any one visible light of red, green and blue lights.

An inert mixed gas, such as He+Xe, Ne+Xe or He+Xe+Ne, for discharge is inserted into discharge spaces of the discharge cells, which are defined between the upper substrate 10 and the barrier ribs 15 and between the lower substrate 18 and the barrier ribs 15.

Such a three-electrode AC surface discharge type PDP is driven with one frame being divided into several sub-fields of different emission numbers in order to implement gray levels of an image. If it is desired to display an image with 256 gray levels, a frame period (16.67 ms) corresponding to 1/60 seconds is divided into 8 sub-fields SF1 to SF8, as shown in FIG. 2. Each of the sub-fields SF1 to SF8 is divided into a reset period for initializing a discharge cell, an address period for selecting a discharge cell, and a sustain period for implementing gray levels according to the number of discharge. The reset period and the address period of each of the sub-fields SF1 to SF8 are the same every sub-field, whereas the sustain period and its discharge number increase in the ratio of $2^n$(n=0, 1, 2, 3, 4, 5, 6, 7) in each sub-field.

Meanwhile, when a frequency of a picture signal is 50 Hz as in the PAL (Phase Alternation by Line) television mode, one frame period of 20 ms includes a number of sub-fields and is time-divided into two sub-field groups having an emission center. This sub-field pattern is shown in FIG. 3. In FIG. 3, "Vsync" is a vertical sync signal, and SFP is a sub-field pattern including a number of sub-fields. The sub-field pattern of FIG. 3 can have two sub-field groups SFG1, SFG2 respectively having an emission center, which are disposed in an overlapping manner, so that flicker can be reduced. If mapped data are displayed on a PDP with the 50 Hz-based sub-field pattern as shown in FIG. 3, however, contour noise is likely to occur two ore more times within one frame period. There also occurs a problem in that contrast characteristics are degraded due to a driving waveform depending upon the arrangement of sub-fields.

Further, the 50 Hz-based sub-field pattern as shown in FIG. 3 serves as a cause to differentiate a picture quality degradation factor depending upon the brightness of an image. For example, in the case where an image is displayed on a PDP with the 50 Hz-based sub-field pattern as shown in FIG. 3, when the brightness of an image is low, the picture quality of the display image is degraded due to contour noise, and when the brightness of an image is relatively high, the picture quality of the display image is degraded due to flicker. This is because the start position of each of the two sub-field groups SFG1, SFG2 is the same regardless of the brightness of an image, i.e., an average picture level (hereinafter, referred to as "APL"), as shown in FIG. 4. In FIG. 4, a start flag Fst is a signal indicating the start position of the first sub-field group SFG1 that is synchronized to a start time point of a frame period. A mid flag Fmid is a start time point of a second sub-field group SFG2 that is set to approximately a half time point of the frame period.

Meanwhile, when the APL is high (H), a large number of sustain pulses is allocated, and when the APL is low (L), a relatively small number of sustain pulses is allocated. Thus, as can be seen from FIG. 4, there is a problem in that an effective length of each of the sub-field groups SFG1, SFG2 varies according to the APL.

SUMMARY OF THE INVENTION

Accordingly, the present invention has been made in view of the above problems occurring in the prior art, and it is an object of the present invention to provide a plasma display apparatus and method of driving the same, wherein contour noise can be minimized when an APL is low and generation of flicker can be prevented when an APL is high.

To achieve the above object, according to an aspect of the present invention, there is provided a method of driving a plasma display panel, including the steps of calculating an average picture level of an input picture, mapping data of the input picture to a first sub-field group and a second sub-field group, and controlling a time range between the data mapped to the first sub-field group and the data mapped to the second sub-field group according to the calculated average picture level, wherein the step of controlling the time range between the data mapped to the first sub-field group and the data mapped to the second sub-field group further includes the steps of: if the average picture level is calculated at a first level, controlling a generating time point of the data mapped to the second sub-field group to be at a first starting time point; if the average picture level is calculated at a second level higher than the first level, controlling the generating time point of the data mapped to the second sub-field group to be at a second starting time point later than the first starting time point; and if the average picture level is calculated at a third level higher than the second level, controlling the generating time point of the data mapped to the second sub-filed group to be at a third starting time point earlier than the second starting time point.

The first sub-field group and the second sub-field group can be disposed within one frame period in a distributed manner.

One frame period is preferably between approximately 16 ms to 20 ms.

The step of controlling the distance between the data mapped to the first sub-field group and the data mapped to the second sub-field group can further include the step of fixing the generating time point of the data mapped to the first sub-field group.

According to an aspect of the present invention, there is provided a plasma display apparatus, including a calculation unit for calculating an average picture level of an input picture, a sub-field mapping unit for mapping data of the input picture to a first sub-field group and a second sub-field group, and a controller for controlling a time range between the data mapped to the first sub-field group and the data mapped to the second sub-field group according to the average picture level, wherein if the average picture level is calculated at a first level, a generating time point of the data mapped to the second sub-field group is controlled to be at a first starting time point, if the average picture level is calculated at a second level higher than the first level, the generating time point of the data mapped to the second sub-field group is controlled to be at a second starting time point later than the first starting time point, and if the average picture level is calculated at a third level higher than the second level, the generating time point of the data mapped to the second sub-filed group is controlled to be at a third starting time point earlier than the second starting time point.

The controller can include a flag generator for generating a start flag that indicates a generating time point of the data mapped to the first sub-field group and a mid flag that indicates a generating time point of the data mapped to the second sub-field group, according to the average picture level, and a data alignment unit for supplying the data mapped to the first sub-field group to a plasma display panel in response to the start flag, and the data mapped to the second sub-field group to the plasma display panel in response to the mid flag.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

The present invention will now be described in detail in connection with preferred embodiments with reference to the accompanying drawings.

Figure 1:
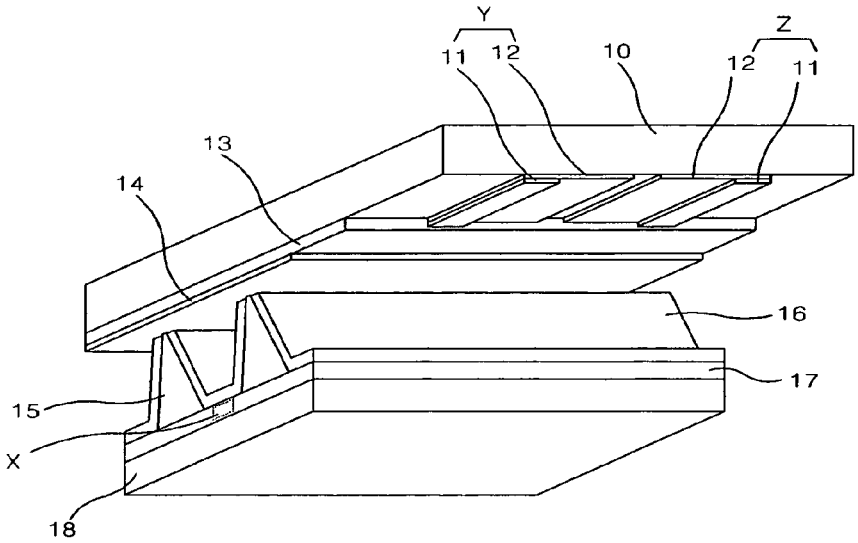
FIG. 1 is a perspective view illustrating the construction of a discharge cell of a conventional three-electrode AC surface discharge type PDP.
Figure 2:
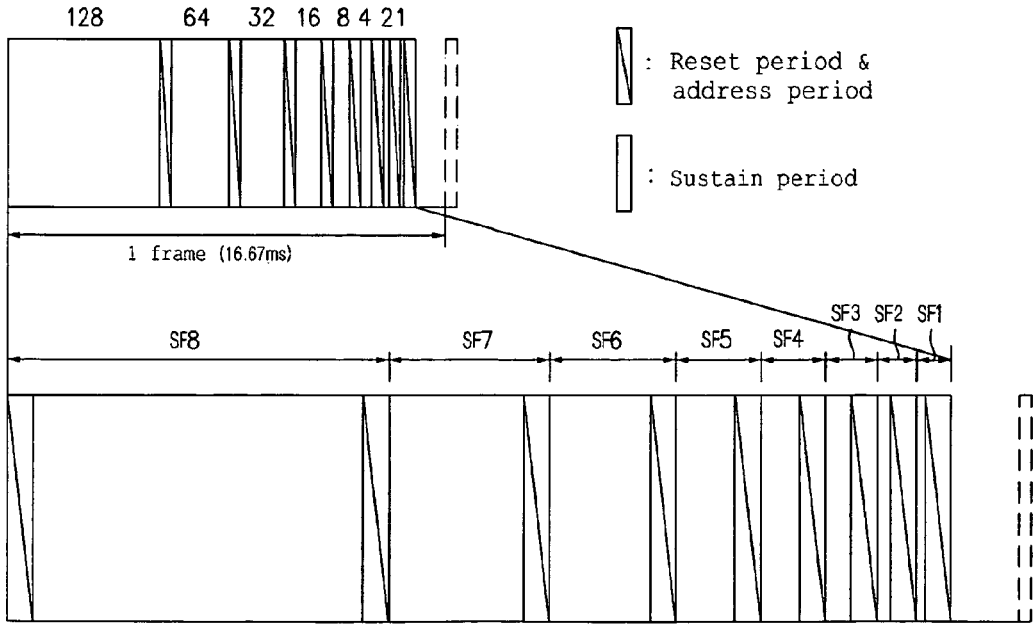
FIG. 2 shows a sub-field pattern including eight sub-fields that are time-divided within one frame period.
Figure 3:
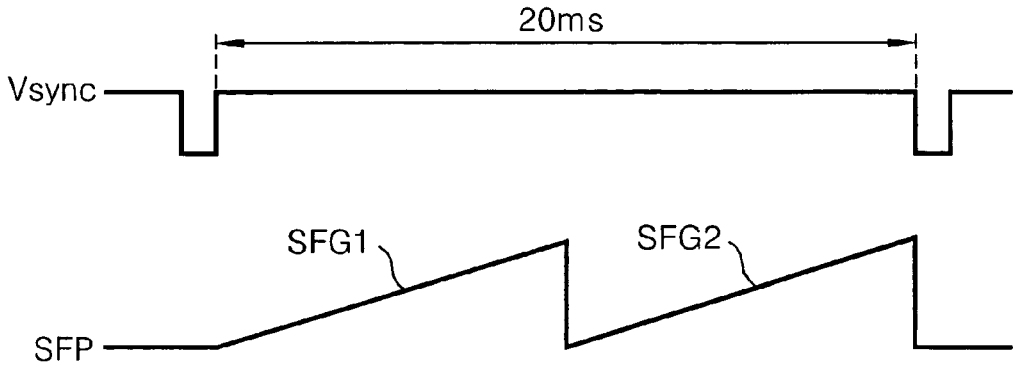
FIG. 3 shows a sub-field pattern for explaining a 50 Hz-driving method.
Figure 4:
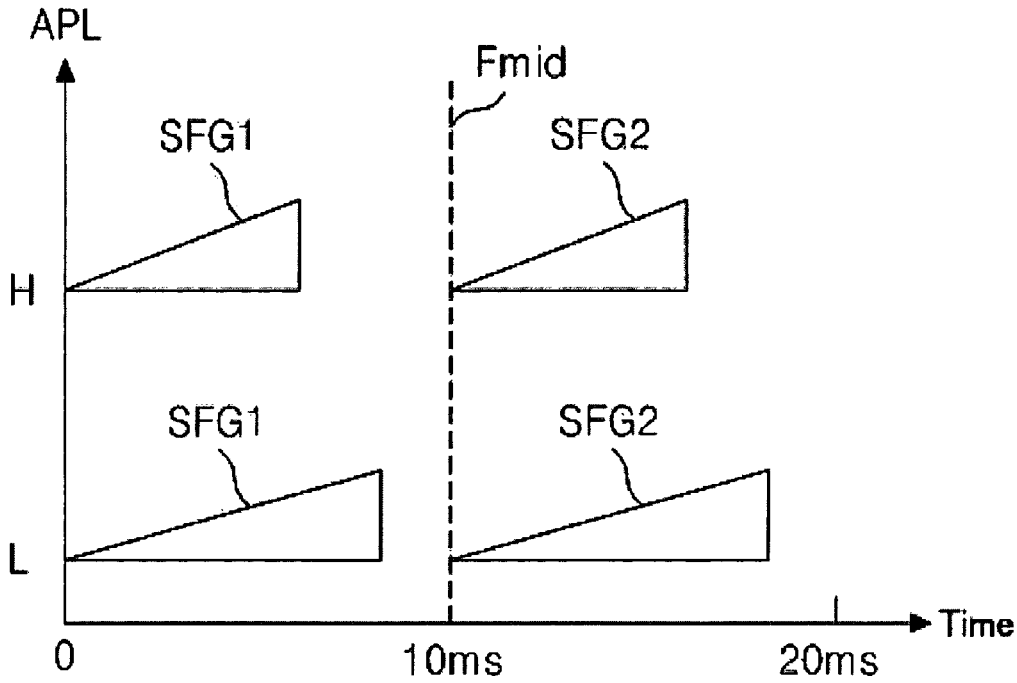
FIG. 4 shows each sub-field group that is fixed regardless of the brightness of an image in a sub-field pattern.
Figure 5:
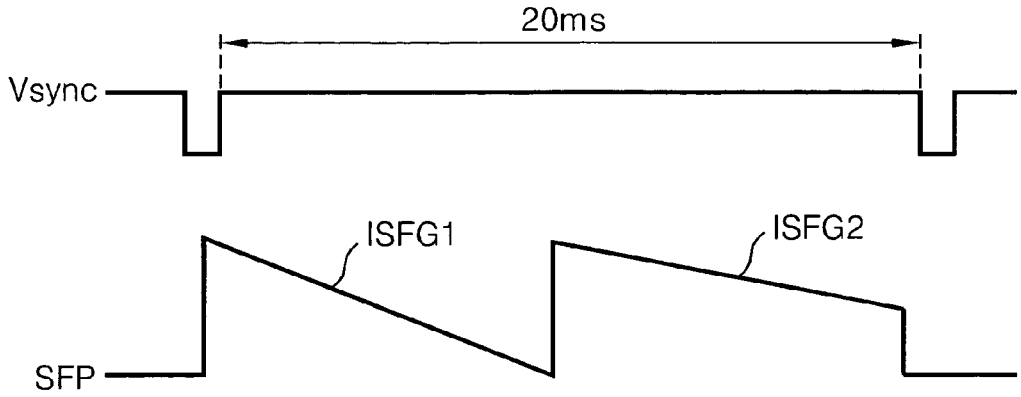
FIG. 5 shows an example of a sub-field pattern used in a PDP according to an embodiment of the present invention.

Referring to FIGS. 3 and 5, a sub-field pattern to which a driving method of a PDP according to an embodiment of the present invention is applied includes two sub-field groups SFG1, SFG2 and ISFG1, ISFG2, which are disposed in order of lower weights and vice versa.

Figure 6:
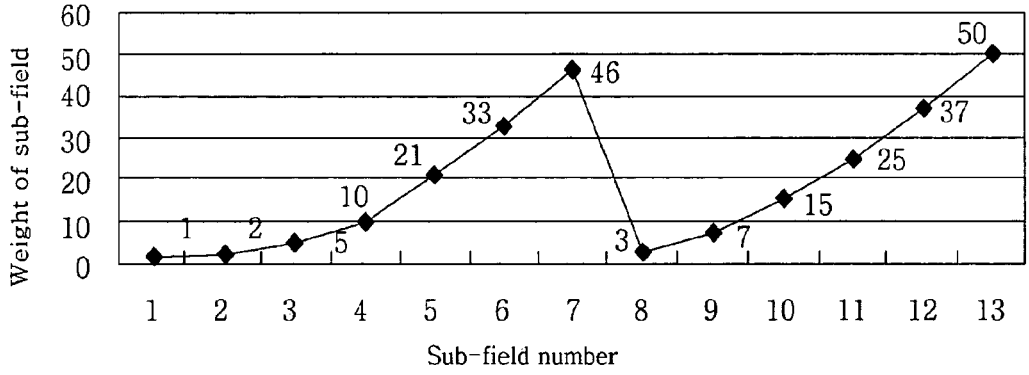
FIG. 6 shows an example of weight assigned to a sub-field pattern as shown in FIG. 3.
Figure 7:
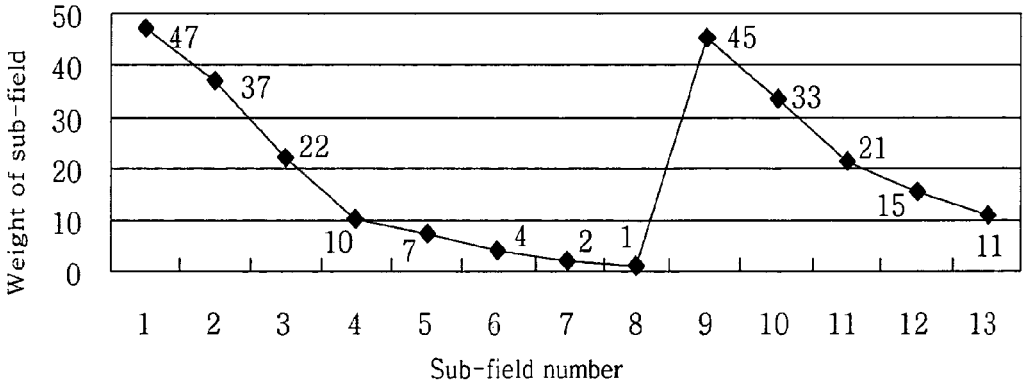
FIG. 7 shows an example of weight assigned to a sub-field pattern as shown in FIG. 5.

Table 1 and FIG. 6 show an example of a sub-field pattern as shown in FIG. 3.

TABLE 1

| Sub-field | SF1 | SF2 | SF3 | SF4 | SF5 | SF6 | SF7 | SF8 | SF9 | SF10 | SF11 | SF12 | SF13 |
|---|---|---|---|---|---|---|---|---|---|---|---|---|---|
| Weight | 1 | 2 | 5 | 10 | 21 | 33 | 46 | 3 | 7 | 15 | 25 | 37 | 50 |

Table 2 and 7 show an example of a sub-field pattern as shown in FIG. 5.

TABLE 2

| Sub-field | SF1 | SF2 | SF3 | SF4 | SF5 | SF6 | SF7 | SF8 | SF9 | SF10 | SF11 | SF12 | SF13 |
|---|---|---|---|---|---|---|---|---|---|---|---|---|---|
| Weight | 47 | 37 | 22 | 10 | 7 | 4 | 2 | 1 | 45 | 33 | 21 | 15 | 11 |

In the sub-field pattern of Table 2, the first sub-field group ISFG1 has sub-fields of a high weight for displaying high gray levels disposed at its front side, and sub-fields of an intermediate weight for displaying intermediate gray levels and sub-fields of a low weight for displaying low gray levels disposed at its rear side. Thus, the first sub-field group ISFG1 has the sub-fields disposed in order of lowering weights.

In the sub-field pattern of Table 2, the second sub-field group ISFG2 is disposed behind the first sub-field group ISFG1. The second sub-field group ISFG2 has sub-fields of a high weight for displaying high gray levels disposed at its front side and sub-fields of an intermediate weight for displaying intermediate gray levels disposed at its rear side. Therefore, in the second sub-field group ISFG2, the $$\text{sub} - \frac{7}{255}s100$$

fields are disposed in order from a high weight to an intermediate weight without the sub-field pattern of the low weight.

Assuming that the highest brightness when a PDP is displayed with full white is 100%, in the sub-field pattern of Table 2, sub-fields of a low weight is defined as sub-fields to which weights below $$\frac{7}{255}s100 = 2.745\%$$

are assigned. Sub-fields of an intermediate weight is defined as sub-fields to which weights from below $$\frac{8}{255}s100 = 3.137\% \text{ to } \frac{80}{255}s100 = 31.373\%$$

are assigned. Further, sub-fields of a high weight is defined as sub-fields to which weights from $$\frac{81}{255}s100 = 31.764\% \text{ to } \frac{255}{255}s100 = 100\%$$

are assigned.

The sub-field pattern of Table 2 represents low gray levels using sub-fields of a low weight within the first sub-field group ISFG1, which are disposed before and after approximately the intermediate time point within one frame period, and represents intermediate and high gray levels using the sub-fields of intermediate and high weights within the first sub-field group ISFG1 and the sub-fields of the intermediate and high weights within the second sub-field group ISFG2, which are disposed in a distributed manner in the first half and the second half within one frame period. When representing the low gray levels with the sub-field pattern of Table 2, a discharge cell becomes consecutively great in the sub-fields of a neighboring low weight. When representing the intermediate and high gray levels with the sub-field pattern of Table 2, a discharge cell becomes consecutively great in the sub-fields of the intermediate and high weights, which are disposed in a distributed manner in the first sub-field group ISFG1 and the second sub-field group ISFG2. Accordingly, in the sub-field pattern of Table 2, sub-fields become consecutively great when representing low gray levels in a motion picture. Therefore, pseudo contour noise in low gray levels can be minimized, luminous distribution is distributed while being temporally in balance when representing the intermediate and high gray levels, and an emission center is rarely shaken. Thus, there is an advantage in that flicker can be reduced in intermediate and high gray levels.

Figure 8:
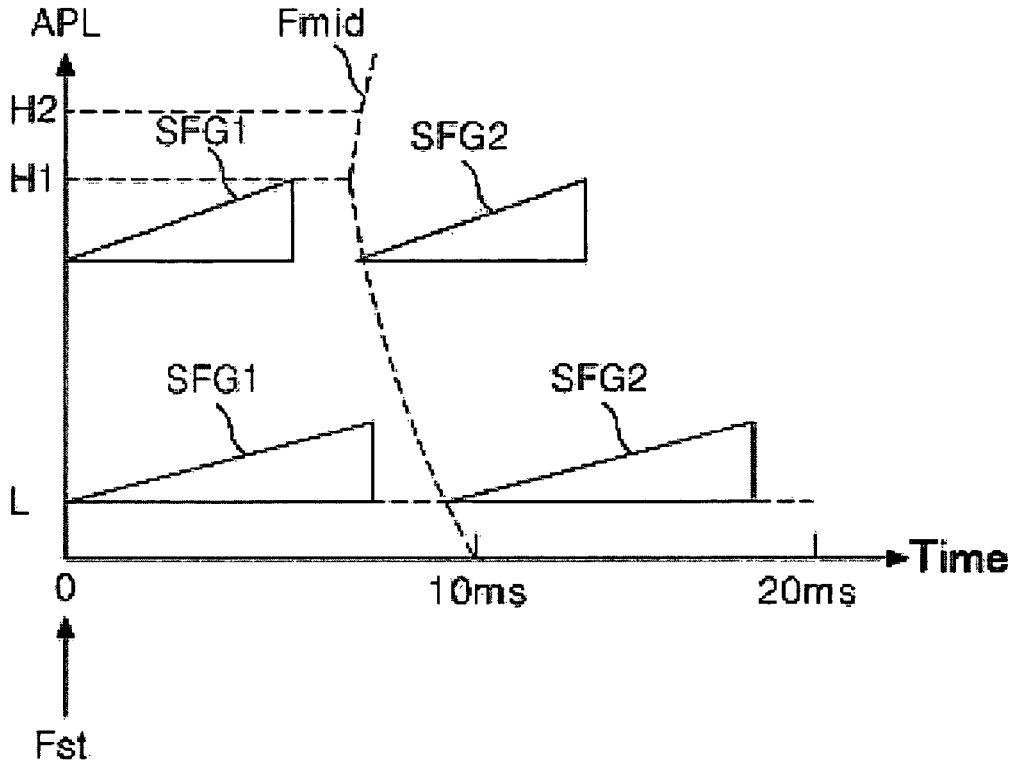
FIGS. 8 and 9 are views illustrating a start position of a second sub-field group that varies according to the brightness of an image in a driving method of a PDP according to a first embodiment of the present invention.
Figure 9:
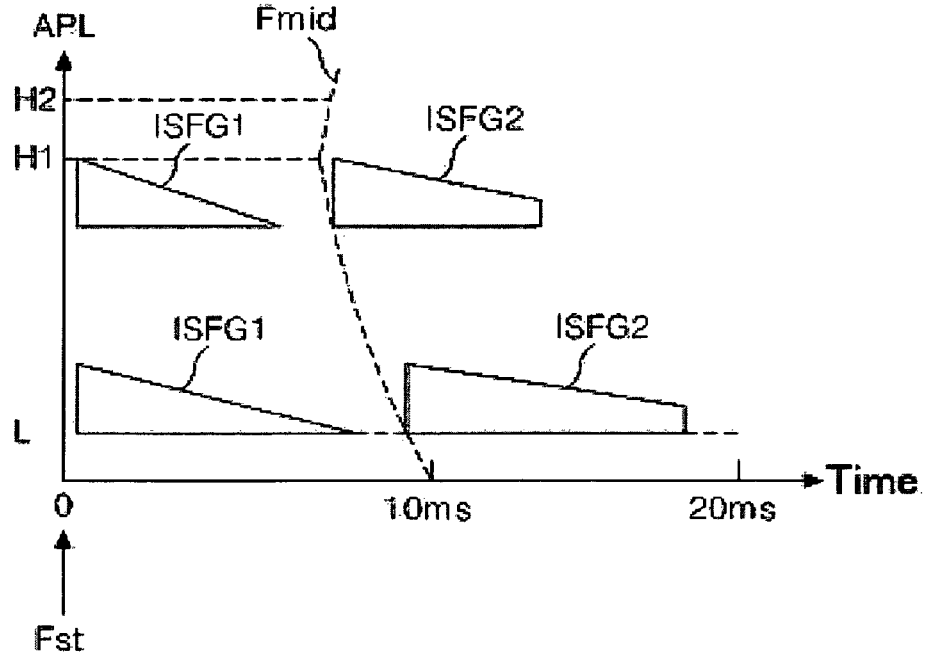

FIGS. 8 and 9 are views for describing a method of differently controlling the start position of data mapped to second sub-field groups SFG2, ISFG2 depending upon the brightness of an image in a driving method of a PDP according to a first embodiment of the present invention.

Referring to FIGS. 8 and 9, the driving method of the PDP according to a first embodiment of the present invention includes generating a start flag Fst at a start time point of a frame period, synchronizing the start position of the first sub-field groups SFG1, ISFG1 to a start position of the frame period, generating a mid flag Fmid late as an APL becomes low, and changing a distance between the first sub-field groups SFG1, ISFG1 and the second sub-field groups SFG2, ISFG2.

Each of the first and second sub-field groups SFG1, ISFG1 and SFG2, ISFG2 is allocated with a less number of sustain pulses as the APL becomes high.

In the present embodiment, the start position of each of the first sub-field groups SFG1, ISFG1 is fixed, whereas the start position of each of the second sub-field groups SFG2, ISFG2 varies. The start position of each of the second sub-field groups SFG2, ISFG2 becomes fast up to below an APL below H1 as the APL becomes high, and becomes slow within a range of an APL between H1 and H2 as the APL becomes high. Therefore, if the brightness of an image is low, i.e., an APL is low, the distance between the first sub-field groups SFG1, ISFG1 and the second sub-field groups SFG2, ISFG2 becomes wide. Therefore, the amount of light is distributed and flicker lowers. If the APL is high, however, the distance between the first sub-field groups SFG1, ISFG1 and the second sub-field groups SFG2, ISFG2 becomes narrow. Therefore, the greater a discharge cell consecutively great, the lower contour noise. Further, in a high APL over H2, the distance between the first sub-field groups SFG1, ISFG1 and the second sub-field groups SFG2, ISFG2 becomes far.

Figure 10:
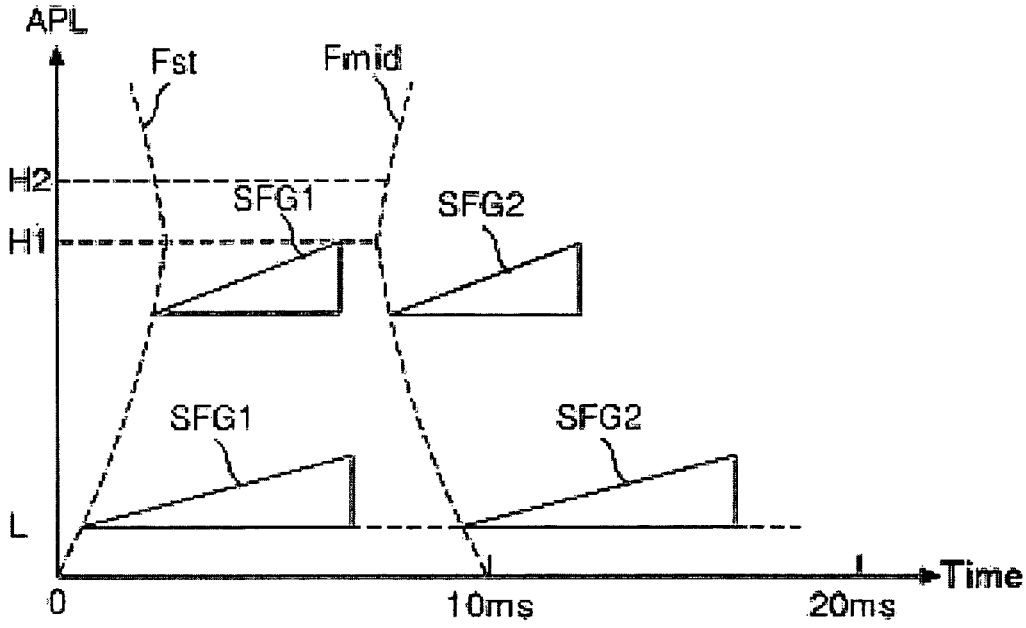
FIGS. 10 and 11 are views illustrating a start position of first and second sub-field groups that vary according to the brightness of an image in a driving method of a PDP according to a second embodiment of the present invention.
Figure 11:
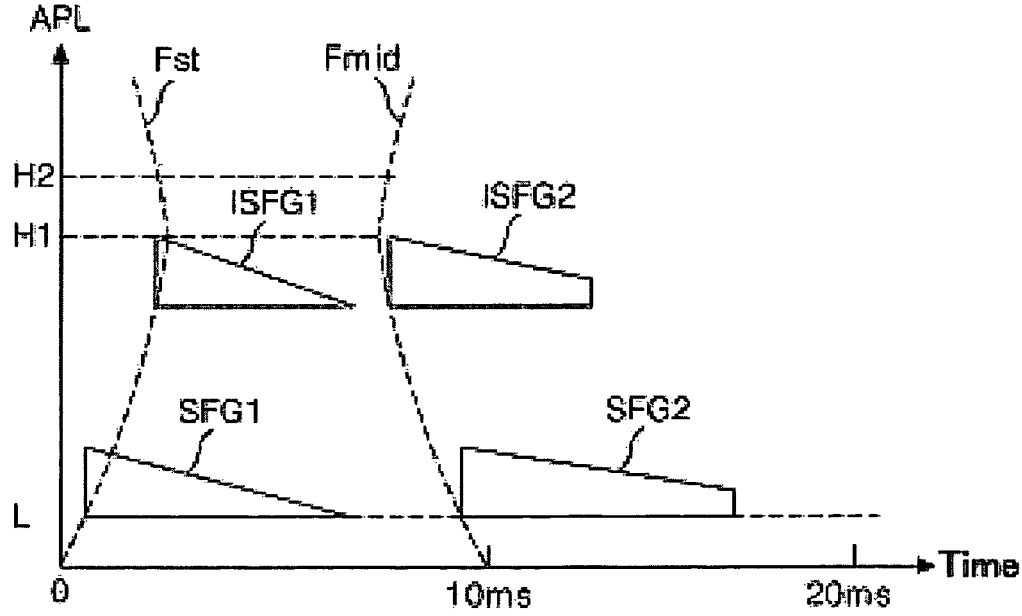

FIGS. 10 and 11 are views for describing a method of differently controlling a start position of data mapped to first sub-field groups SFG1, ISFG1 and a start position of data mapped to second sub-field groups SFG2, ISFG2 depending upon the brightness of an image in a driving method of a PDP according to a second embodiment of the present invention.

Referring to FIGS. 10 and 11, in the driving method of the PDP according to a second embodiment of the present invention, a generating time point of a start flag Fst and a mid flag Fmid is changed, so that a distance between the first sub-field groups SFG1, ISFG1 and the second sub-field groups SFG2, ISFG2 varies.

Each of the first and second sub-field groups SFG1, ISFG1 and SFG2, ISFG2 is allocated with a less number of sustain pulses as an APL is higher.

The start position of each of the first sub-field groups SFG1, ISFG1 becomes slow up to below an APL below H1 as the APR becomes high, and becomes fast with a range of an APL between H1 and H2 as the APL becomes high. The start position of each of the second sub-field groups SFG2, ISFG2 becomes fast up to below an APL below H1 as the APL becomes high, and becomes slow within a range of an APL between H1 and H2 as the APL becomes high. Therefore, if the brightness of an image is low, i.e., an APL is low, a distance between the first sub-field groups SFG1, ISFG1 and the second sub-field groups SFG2, ISFG2 becomes wide. Thus, the amount of light is distributed and flicker is lowered. If the APL is high, however, the distance between the first sub-field groups SFG1, ISFG1 and the second sub-field groups SFG2, ISFG2 becomes narrow. Thus, as a discharge cell becomes consecutively great, contour noise reduces. Further, in a high APL over H2, a distance between the first sub-field groups SFG1, ISFG1 and the second sub-field groups SFG2, ISFG2 becomes far.

Figure 12:
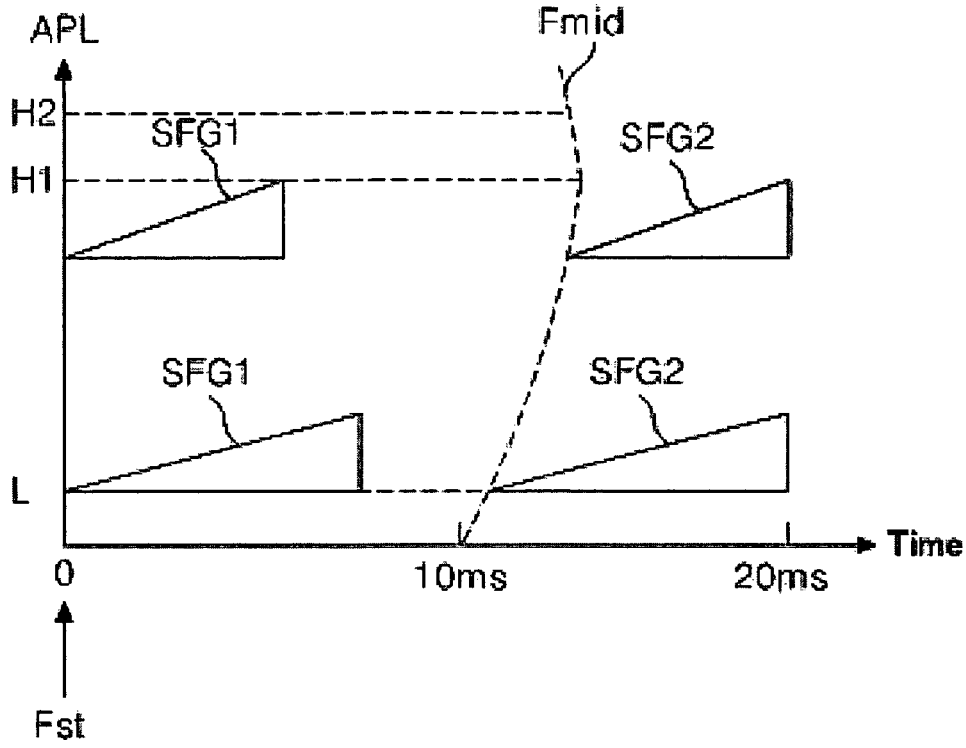
FIGS. 12 and 13 are views illustrating a start position of a second sub-field group that varies according to the brightness of an image in a driving method of a PDP according to a third embodiment of the present invention.
Figure 13:
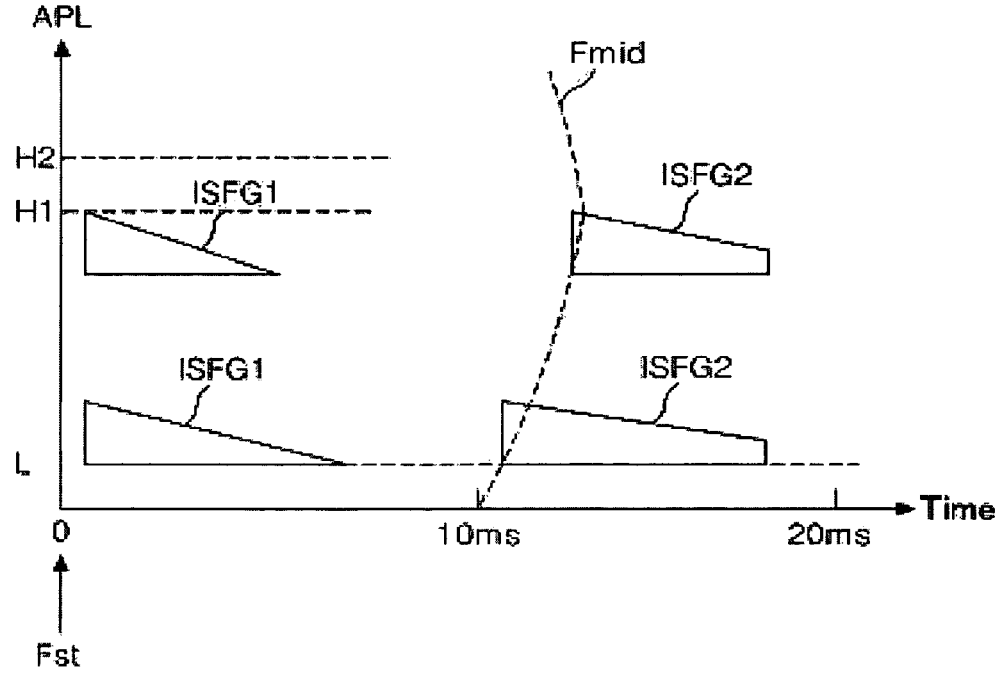

FIGS. 12 and 13 are views for describing a method of differently controlling the start position of each of second sub-field groups SFG2, ISFG2 depending upon the brightness of an image in a driving method of a PDP according to a third embodiment of the present invention.

Referring to FIGS. 12 and 13, the driving method of the PDP according to a third embodiment of the present invention includes generating a start flag Fst at a start time point of a frame period, synchronizing the start position of the first sub-field groups SFG1, ISFG1 to the start position of the frame period, generating a mid flag Fmid fast as an APL becomes low, and changing a distance between the first sub-field groups SFG1, ISFG1 and the second sub-field groups SFG2, ISFG2.

In the present embodiment, the start position of each of the first sub-field groups SFG1, ISFG1 is fixed, whereas the start position of each of the second sub-field groups SFG2, ISFG2 varies. The start position of each of the second sub-field groups SFG2, ISFG2 becomes slow up to an APL below H as the APL is higher.

As a result, the method of driving the PDP according to the present invention can remove the picture quality degradation factors that are differently shown according to the brightness of an image by changing a distance between first and second sub-field groups SFG1, ISFG1 and SFG2, ISFG2.

More particularly, the driving method of the PDP according to the present invention can minimize contour noise, which is visually more profound to the naked eyes when an APL is low, and flicker, which is visually more profound to the naked eyes when an APL is high.

Figure 14:
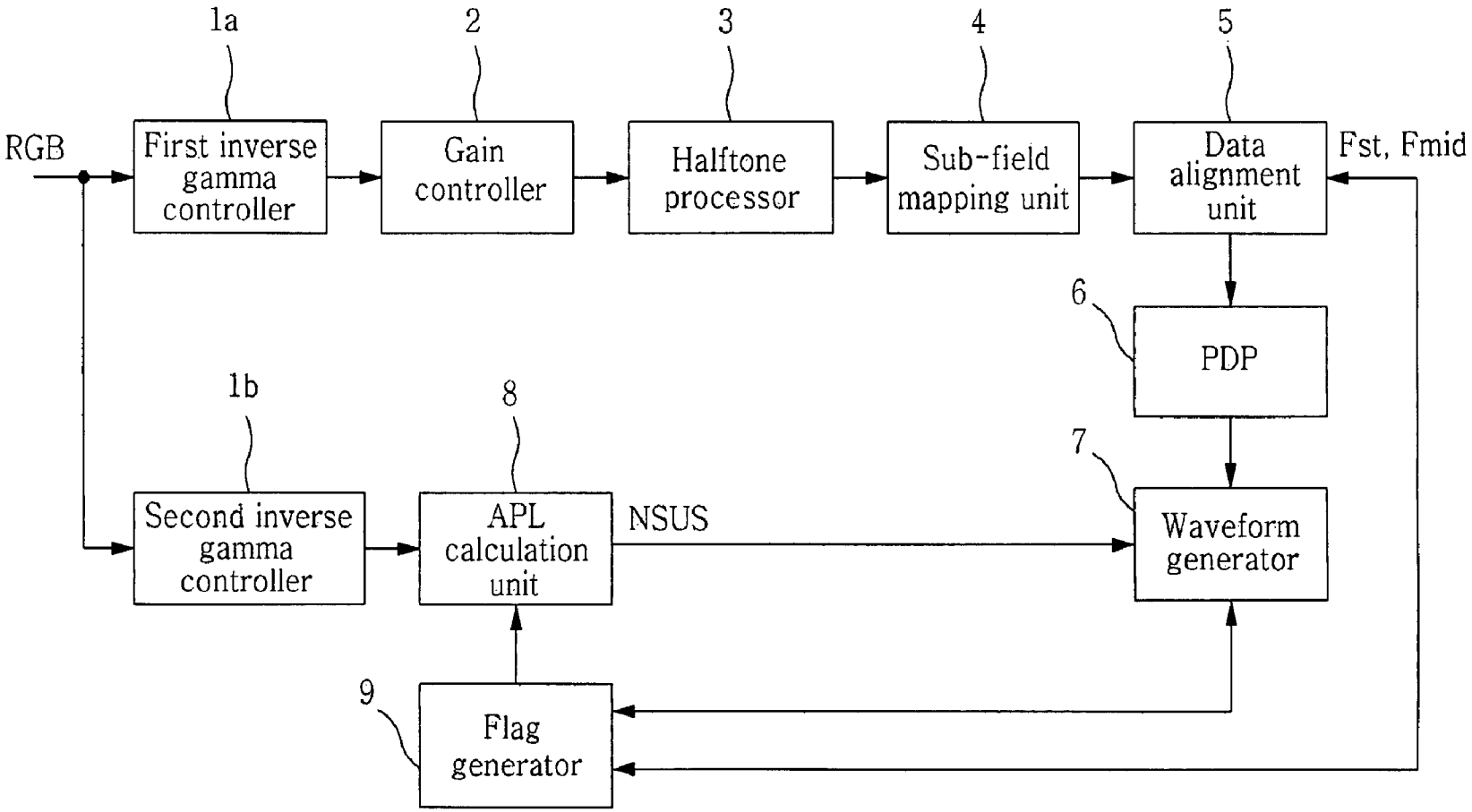
FIG. 14 is a block diagram illustrating an apparatus for driving a PDP according to an embodiment of the present invention.

FIG. 14 is a block diagram illustrating an apparatus for driving a PDP according to an embodiment of the present invention.

Referring to FIG. 14, a picture quality control apparatus of the PDP according to the present invention includes a gain controller 2, a halftone processor 3 and a sub-field mapping unit 4, all of which are connected between a first inverse gamma controller 1*a* and a data alignment unit 5, an APL calculation unit 8 connected between a second inverse gamma controller 1*b* and a waveform generator 7, and a flag generator 9 that generates a start flag Fst and a mid flag Fmid according to an APL.

Each of the first and second inverse gamma correction units 1*a*, 1*b* performs a 2.2 inverse gamma correction process on digital video data (RGB), which are received from an input line, to linearly convert the brightness for gray level values of a picture signal.

The gain controller 2 compensates for color temperature by controlling an effective gain every data of red, green and blue.

The halftone processor 3 performs an error diffusion process on the digital video data (RGB), which are received from the gain controller 2, to diffuse quantization error to neighboring cells, and finely controls a brightness value by thresholding quantization error using a predetermined dither mask.

The sub-field mapping unit 4 previously maps data, which are received from the halftone processor 3, to a sub-field pattern as shown in Table 1 and Table 2, on a bit basis, and supplies the mapped data to the data alignment unit 5.

The data alignment unit 5 supplies the digital video data, which are received from the sub-field mapping unit 4, to a data driving circuit of a PDP 6. The data driving circuit includes a number of integrated circuits and is connected to address electrodes of the PDP 6. The data driving circuit serves to latch data received from the data alignment unit 5 every one horizontal line, and supplies the latched data to the address electrodes of the PDP 6 on a horizontal period basis. Further, the data alignment unit 5 changes the distance between the first sub-field groups SFG1, ISFG1 and the second sub-field groups SFG2, ISFG2 in the sub-field pattern of Table 1 and Table 2 according to the flags Fst, Fmid output from the flag generator 9. The data alignment unit 5 changes a supply time point of each of data mapped to the first sub-field groups SFG1, ISFG1 and data mapped to the second sub-field groups SFG2, ISFG2 in response to the flags Fst, Fmid output from the flag generator 9.

The waveform generator 7 generates a timing control signal in response to a sustain pulse number Nsus output from the APL calculation unit 8, and supplies the timing control signal to a scan driving circuit (not shown) and a sustain driving circuit (not shown) of the PDP 6. The scan driving circuit and the sustain driving circuit supply sustain pulses to scan electrodes and sustain electrodes of the PDP 6 during a sustain period in response to the timing control signal from the waveform generator 7.

Figure 15:
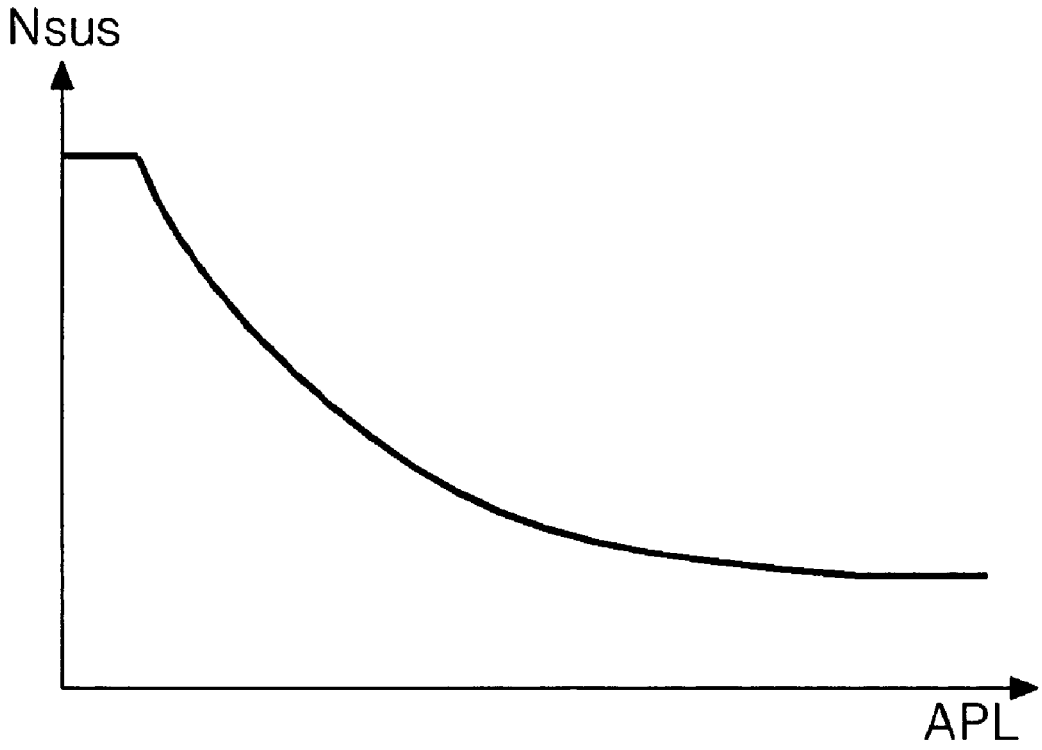
FIG. 15 is a graph showing an APL versus a sustain pulse number, which is previously set in the APL calculation unit shown in FIG. 14.

The APL calculation unit 8 includes a ROM in which an APL curve as shown in FIG. 15 is stored in the form of a look-up table, and an address control circuit for accessing the ROM. The APL calculation unit 8 relatively reduces the sustain pulse number Nsus if the brightness of a picture signal is bright, i.e., if the APL is high, but increases the sustain pulse number Nsus if the brightness of the picture signal is low, i.e., if the APL is low, according to the APL curve of FIG. 15.

The flag generator 9 counts a vertical sync signal as a clock signal to generate the start flag Fst and the mid flag Fmid as shown in FIGS. 8 to 13, and supplies the start flag Fst and the mid flag Fmid to the data alignment unit 5. Further, the flag generator 9 can sense a driving waveform generated from the waveform generator 7, count a time from the last driving waveform of the first sub-field groups SFG1, ISFG1, and generate the mid flag Fmid.

The APL calculation unit 8, the flag generator 9 and the data alignment unit 5 serve as control means for controlling a distance between data mapped to the first sub-field groups SFG1, ISFG1 and data mapped to the second sub-field groups SFG2, ISFG2 according to the brightness of an image.

As described above, according to the present invention, an image of one frame for an input picture of 50 Hzs is mapped to two sub-field groups respectively having an emission center, and data that are mapped to different sub-field groups within one frame period (20 ms) are consecutively displayed on a PDP. This causes an optimized picture quality process to be performed on data that will be mapped to each of different sub-field groups to which the same picture is mapped according to the sub-field groups. It is therefore possible to reduce flicker and contour noise of a display image and also to improve the gray level display capability.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A method of driving a plasma display panel, comprising the steps of:

calculating an average picture level of an input picture;

mapping data of the input picture to a first sub-fiend group and a second sub-field group; and controlling a time range between the data mapped to the first sub-field group and the data mapped to the second sub-field group according to the calculated average picture levels, wherein the step of controlling the time range between the data mapped to the first sub-field group and the data mapped to the second sub-field group further includes the steps of:

if the average picture level is calculated at a first level, wherein the first level is less than a predetermined reference level, controlling a generating time point of the data mapped to the second sub-field group to be at a first starting time point;

if the average picture level is calculated at a second level higher than the first level, wherein the second level is less than the predetermined reference level, controlling the generating time point of the data mapped to the second sub-field group to be at a second starting time point later than the first starting time point; and if the average picture level is calculated at a third level higher than the second level, wherein the third level is higher than the predetermined reference level, controlling the generating time point of the data mapped to the second sub-field group to be at a third starting time point earlier than the second starting time point.

2. The method as claimed in claim 1, wherein the first sub-field group and the second sub-field group are disposed within one frame period in a distributed manner.

3. The method as claimed in claim 1, wherein the step of controlling the distance between the data mapped to the first sub-field group and the data mapped to the second sub-field group further includes the step of fixing the generating time point of the data mapped to the first sub-field group.

4. The method as claimed in claim 2, wherein the one frame period is between approximately 16 ms to 20 ms.

5. A plasma display apparatus, comprising:

a calculation unit for calculating an average picture level of an input picture;

a sub-field mapping unit for mapping data of the input picture to a first sub-field group and a second sub-field group; and a controller for controlling a time range between the data mapped to the first sub-field group and the data mapped to the second sub-field group according to the average picture level, wherein if the average picture level is calculated at a first level, wherein the first level is less than a predetermined reference level, a generating time point of the data mapped to the second sub-field group is controlled to be at a first starting time point, if the average picture level is calculated at a second level higher than the first level, wherein the second level is less than the predetermined reference level, the generating time point of the data mapped to the second sub-field group is controlled to be at a second starting time point later than the first starting time point, and if the average picture level is calculated at a third level higher than the second level, wherein the third level is higher than the predetermined reference level, the generating time point of the data mapped to the second sub-field group is controlled to be at a third starting time point earlier than the second starting time point.

6. The plasma display apparatus as claimed in claim 5, wherein the first sub-field group and the second sub-field group are disposed within one frame period in a distributed manner.

7. The plasma display apparatus as claimed in claim 5, wherein the controller includes:

a flag generator for generating a start flag that indicates a generating time point of the data mapped to the first sub-field group and a mid flag that indicates a generating time point of the data mapped to the second sub-field group, according to the average picture level; and a data alignment unit for supplying the data mapped to the first sub-field group to a plasma display panel in response to the start flag, and the data mapped to the second sub-field group to the plasma display panel in response to the mid flag.

8. The plasma display apparatus as claimed in claim 5, wherein the controller fixes the generating time point of the data mapped to the first sub-field group.

9. The plasma display apparatus as claimed in claim 6, wherein the one frame period is between approximately 16 ms to 20 ms.

* * * * *